United States Patent [19]

Cope

[11] 4,236,457

[45] Dec. 2, 1980

[54] STEERABLE RAILWAY TRUCK ADAPTER PAD CENTERING MEANS

[75] Inventor: Geoffrey W. Cope, Williamsville, N.Y.

[73] Assignee: Dresser Industries, Inc., Dallas, Tex.

[21] Appl. No.: 964,030

[22] Filed: Nov. 27, 1978

[51] Int. Cl.[3] ..... B61F 5/30; B61F 5/38

[52] U.S. Cl. ..... 105/218 R; 105/222; 105/224.1

[58] Field of Search ..... 105/218 R, 222, 224.1

[56] References Cited

U.S. PATENT DOCUMENTS

| | | | |
|---|---|---|---|
| 3,380,400 | 4/1968 | Barber | 105/218 R |
| 3,638,582 | 2/1978 | Beebe | 105/218 |

*Primary Examiner*—Richard A. Bertsch
*Attorney, Agent, or Firm*—Richard M. Byron

[57] ABSTRACT

An adapter pad centering device for the side frame of a radially steerable railway car truck with pedestal jaws on opposed end portions thereof for mounting railway car wheel assemblies equipped with a resilient bearing adapter pad mounted between the bearing adapter and the pedestal jaw roof. The adapter pad centering device includes a pair of rigid adapter pad stops on the side frame at opposed sides of the pedestal jaw opening at the roof thereof. Each of the stops has an abutment extending transverse to the side frame. These abutments are spaced so that when the adapter pad is positioned between them, an upper portion of the pad is restrained from significant movement in the longitudinal direction of the side frame. The lower portion of the adapter pad is attached to the bearing adapter and temporarily displaced during steering motions of the truck.

11 Claims, 10 Drawing Figures

STEERABLE RAILWAY TRUCK ADAPTER PAD CENTERING MEANS

TECHNICAL FIELD

This invention is related to wheel and axle support assemblies for radially steerable railway trucks. More specifically the invention is related to the retention of a resilient pad in the movable connection between the axle bearing assembly and the pedestal jaw for a radially steerable railway car truck.

BACKGROUND OF THE INVENTION

Radially steerable railway car trucks with employ steering arms to transmit the lateral forces between the wheel sets comprising the axles and their associated bearings during the self-steering operation typically have a resilient adapter pad between the axle bearing adapter and the roof of the pedestal jaw to provide a flexible connection between the axle and the side frame. When the brakes are applied to the wheel treads of a truck having this configuration, the wheel sets are urged outward and under this light car conditions can displace the adapter pad on the pedestal jaw roof in the outward direction. Once the brakes are no longer applied, the adapter pad can remain in an outwardly displaced position. This unwanted outward displacement inhibits the self-steering action of the wheel set in the outward direction and is undesirable because it induces unbalanced forces into the steering system which can cause it to operate inefficiently. For a steering system which is retrofitted to an existing or AAR (American Association of Railroads) standard side frame, this problem is particularly acute because the pedestal jaw roof is sufficiently large longitudinally to permit a substantial displacement of the adapter pad during the braking conditions.

SUMMARY OF THE INVENTION

In an embodiment the adapter pad centering device for each pedestal jaw includes a U-shaped member secured to the side frame at the outer side of each pedestal jaw opening at the roof wherein these U-shaped members form a pair of rigid adapter pad stops which function to restrain outward motion of the upward portion of the adapter pad adjacent to the pedestal jaw roof.

In another embodiment the adapter pad centering device includes a pair of rigid adapter pad stops for the pedestal jaw which are integrally formed with the side frame and positioned to restrain from motion the upper portion of the adapter pad.

One object of this invention is to provide an adapter pad centering device which will overcome the aforementioned disadvantage of the prior art construction.

Still, one other object of this invention is to provide an adapter pad centering device which can be mounted on AAR standard side frames or other existing side frames when the railway truck is retrofitted for radial steering.

Still, another object of this invention is to provide an adapter pad centering device for a radially steerable railway truck which positions the adapter pads thereof so they are not displaced during braking operations to a position which would adversely influence steering characteristics of the truck.

Various other objects, advantages, and features of this invention will become apparent to those skilled in the art from the following discussion, taken in conjunction with the accompanying drawings, in which:

Figure 1:
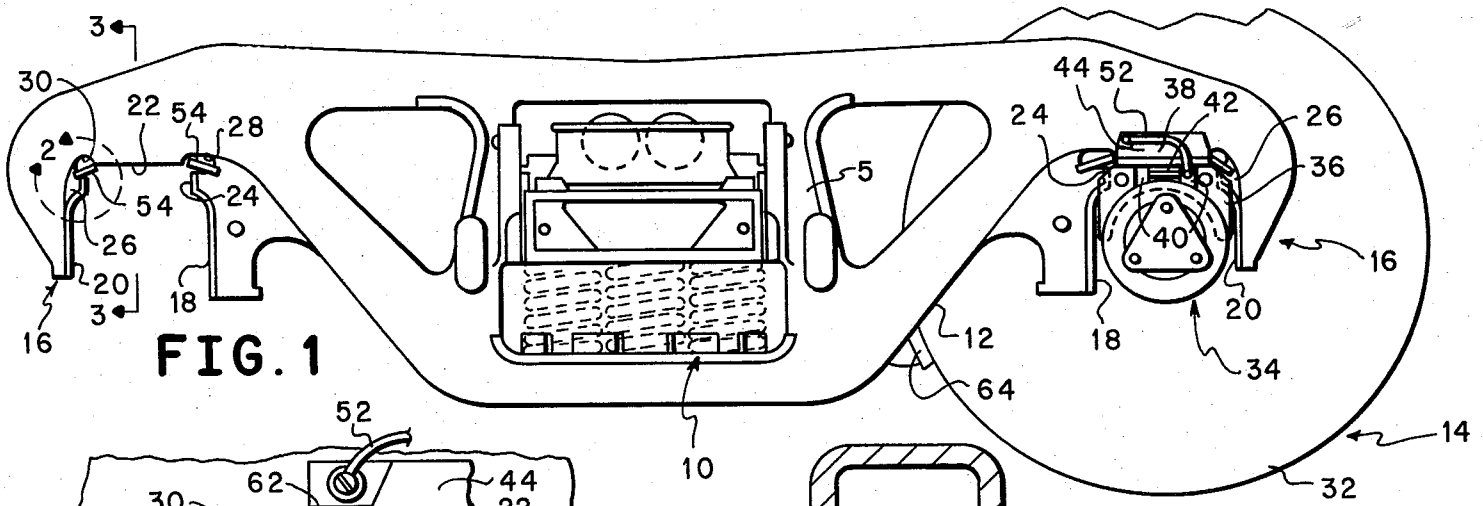
FIG. 1 is a side elevation view of a steerable railway truck having a wheel assembly mounted at one end and having the wheel assembly removed from the pedestal jaw at the opposite end thereof.

The following is a discussion and description of specific embodiments of the adapter pad centering device of this invention, with such description being made with reference to the drawings, whereupon the same reference numerals are used to indicate the same or similar parts and/or structure. It is to be understood that such discussion and description is not to unduly limit the scope of the invention.

DETAILED DESCRIPTION

Referring to the drawings in detail and in particular to FIG. 1 which shows the adapter pad centering device in a partially assembled radially steerable railway car truck having a bolster 10 mounted with a side frame 12 and one complete wheel assembly 14 mounted in one of the side frame pedestal jaws. On the left hand side of FIG. 1, the pedestal jaw, indicated generally at 16 is shown without the wheel assembly. Pedestal jaw 16 is a downwardly opening yoke at each end of side frame 12 to mount the wheel assembly. Each of the pedestal jaws 16 have an inner wall 18, an outer wall 20 facing the inner wall and on the outer end of the side frame, a roof 22 at the closed end portion of the opening and oriented and generally horizontal position. Within the opening of the pedestal jaw, stop lugs 24 and 26 are formed as protrusions from inner wall 18 and outer wall 20 respectively. An arcuate shaped stress concentration relieving recess 28 is formed at the juncture of pedestal jaw inner wall 18 and pedestal jaw roof 22. On the opposite side of the opening, a similar stress concentration relieving recess 30 is formed at the intersection of outer wall 20 and roof 22. Because the pedestal jaw construction is the same on both ends of side frame 12, the same numerals are applied to similar elements of both pedestal jaws.

Reference is now made to the right hand portion of FIG. 1 which shows a complete wheel assembly 14 mounted within pedestal jaw 16. The wheel assembly 14 includes a standard railroad car wheel 32 rigidly mounted with an axle (not visible), a bearing assembly 34 mounted on the end portion of the axle, a bearing adapter 36 positioned over the upper portion of bearing assembly 34 and an adapter pad 38 positioned between bearing adapter 36 and pedestal jaw roof 22. The relationship of bearing 34, bearing adapter 36, adapter pad 38 and pedestal jaw roof 22 is shown clearly in FIg. 2. Bearing adapter 36 is provided with a radially inwardly extending flange on the outer or visible portion thereof to encircle a large portion of the bearing perimeter. The supportive portion of bearing adapter 36 is curved and rests on the upper portion of bearing assembly 34. The upper side of bearing adapter 36 is substantially flat and provides a smooth resting surface for adapter pad 38. The distance between the ends of bearing adapter 36 is substantially narrower than the spacing between the facing surfaces of stop lugs 22 and 24 in order to allow for displacement of the wheel assembly as needed for the radial steering. Adapter pad 38 has a pair of down-turned lugs 40 on the inner and outer sides thereof for fitting over and securing it in a locking engagement with bearing adapter 36. The pair of down-turned lugs on the inner side of adaper pad 38 are not visible in the figures. Bearing adapter 36 has an outwardly extending lug 42 positioned between adapter pad down-turned lugs 40 and cooperative with these lugs to secure the lower portion of the adapter pad to the bearing adapter.

Figure 2:
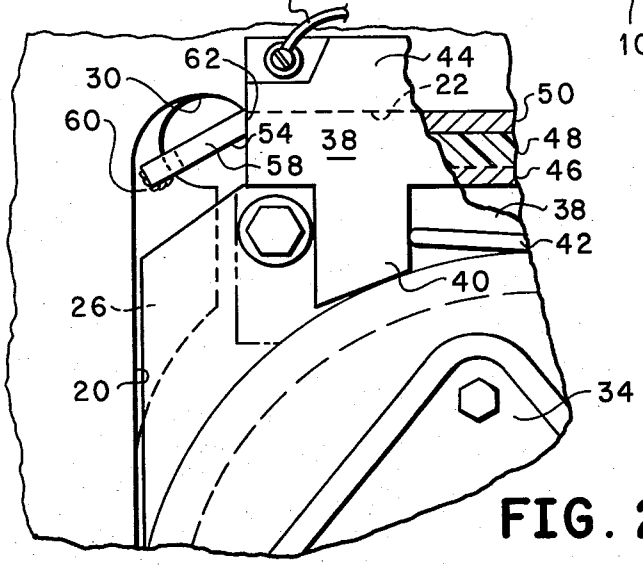
FIG. 2 is an enlarged cutaway elevation view of a portion of the pedestal jaw shown in the left hand side of FIG. 1 with the bearing, bearing adapter and adapter pad shown positioned therein.

Adapter pad 38 has a pair of elongated up-turned lugs 44 extending upward from the inner and outer sides thereof. The up-turned adapter pad lugs 44 fit along the inner and outer sides of side frame above pedestal jaw roof 22 and position the adapter pad laterally on the side frame. The adapter pad 38 is provided with internal metal forming members which are separated by a resilient elastic material such as an elastomeric compound. With this construction, the adapter pad can be subjected to shear forces in a direction longitudinally aligned with side frame 12 and deformed in this direction due to deformation to the resilient material. FIG. 2 shows adapter pad 38 in a cutaway form where the lower forming member 46, the resilient material 48 and the upper forming member 50 are clearly visible. The upper and lower forming members 46 and 50 are connected by a ground strap 52 visible in FIG. 1 and provided for safety reasons.

Figure 3:
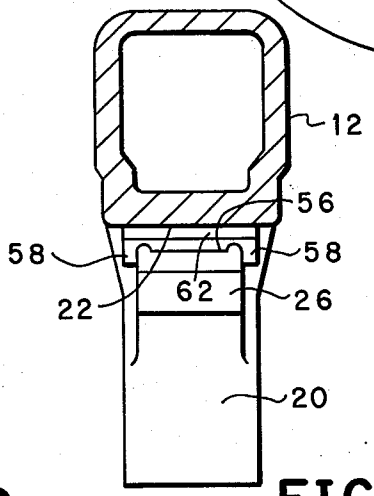
FIG. 3 is a cross-sectional elevation view taken through the side frame at the pedestal jaw on line 3—3 of FIG. 1.
Figure 4:
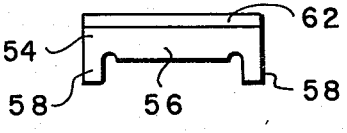
FIG. 4 is an elevation view of the lower side of the U-shaped adapter pad stop shown in FIGS. 2 and 3.

An embodiment of the adapter pad centering device of this invention is shown in FIG. 1 and in detail in FIGS. 2—4. An embodiment of the adapter pad centering device includes a single adapter pad stop member 54 mounted with side frame 12 within the pedestal jaw opening and positioned adjacent to pedestal jaw roof 22 at outer wall 20 only. Another embodiment of the invention includes a pair of adapter pad stop members within each pedestal jaw which are mounted in a spaced relation to each other in order to accommodate the upper portion of adapter pad 38 therebetween.

Each adapter pad stop member 54 is generally U-shaped and comprised of a transverse segment 56 with legs 58 extending from the ends thereof. Legs 58 are secured to side frame 12 at opposite sides of the stop lugs and transverse segment 56 is positioned adjacent to pedestal jaw roof 22. FIG. 2 shows adapter pad stop member legs 58 secured to stop lug 26 by a weld bead 60. Legs 58 are secured to both inner and outer sides of stop lug 26. Transverse segment 56 is provided with a flat or planer abutment surface 62 on an outer portion thereof which forms an abutment that is contacted by an end of adapter pad 48. Abutment surface 62 for adapter pad stop 54 is inclined relative to the longitudinal axis of legs 58 so the stop member can be mounted in an angularly oriented position as shown in FIG. 2 with abutment surface 62 being generally parallel to the end surface of adapter pad 48. Abutment surface 62 is positioned generally perpendicular to pedestal jaw roof 22 and adjacent thereto so it will contact upper forming member 50 of adapter pad 38 and effectively restrain that portion from movement in longitudinal alignment with the side frame during steering motions of the truck and when the brakes are applied. Abutment surface 62 generally aligns with adapter pad upper forming member 50 at pedestal jaw roof 22.

During steering motions of the railway car truck, the wheel set and steering arms are displaced by forces developed at the wheel tread. This displacement moves bearing 34 closer to one or the other of the pedestal jaw walls depending upon the direction of the turning. When this occurs, the resilient portion 48 of adapter pad 38 is deformed due to shearing forces applied to the top and the bottom thereof by side frame 12 and bearing adapter 36. When this occurs, adapter pad 38 has a tendency to move toward one of the adapter pad stop members. However, because adapter pad 38 is restrained from outward motion by the abutments formed by the adapter pad stop members then no longitudinal displacement of adapter pad 38 can occur during steering movements of the truck. Also because adapter pad 38 remains in a centered position, its resilient nature applies a recentering force when the wheels are repositioned into a parallel arrangement after turning wherein bearing adapter 36 is moved to a centered position in pedestal jaw 16. When the brakes are applied to the truck, the brake shoes are displaced outward from the center portion of the truck and make contact with inner sides of the wheel treads thereby displacing them outward relative to bolster 10. This braking action can cause excessive adapter pad force particularly when braking action is at full service or emergency capacity when it can overcome the steering forces and displace the wheel set in the maximum outward position with the adapters against the stop lugs 26. The adapter pad stops formed by abutments of the adapter pad stop members prevent displacement of the adapter pad upper or lower portions 50 and 46 from the normal operating position during this maximum wheel set displacement.

The arrangement of the adapter pad stop members shown in FIG. 1 have a stop member located at both sides of each pedestal jaw. With this arrangement, the upper portion of the adapter pads are retained in a centered position within pedestal jaw 16 for all operating conditions. The transverse portions of these stop members 54 are in a spaced relation such that adapter pad 38 fits between them and in a centered relation in the pedestal jaw opening.

Figure 5:
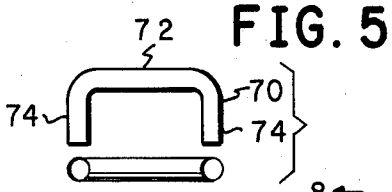
FIG. 5 is a side elevation view and an open end elevation view of a U-shaped and cross-sectionally round adapter pad stop member.
Figure 6:
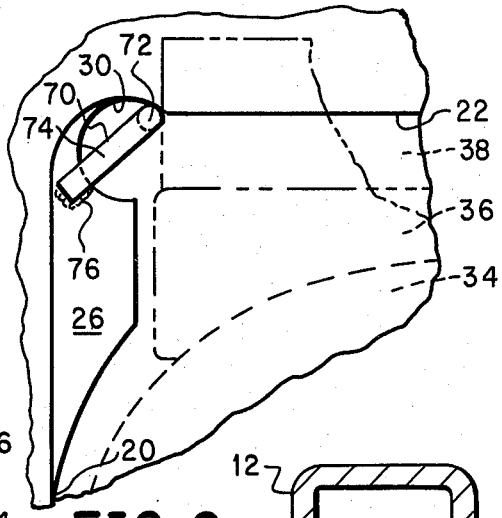
FIG. 6 is an elevation view of a fragment of a side frame employing the embodiment of the adapter pad stop member shown in FIG. 5 and having the bearing, bearing adapter and adapter pad shown in dashed lines.

FIGS. 5 and 6 show another embodiment of the adapter pad centering device of this invention wherein this adapter pad stop member 70 is constructed with a U-shaped and cross-sectionally round configuration. The stop member 70 is formed with a transverse segment 72 and integrally connected legs 74 at each end thereof as shown clearly in FIG. 5.

FIG. 6 shows adapter pad stop member 70 mounted with side frame 12. Adapter pad stop member legs 74 are secured to stop lug 26 by a weld bead 76. The adapter pad stop member legs are positioned in an angular orientation as shown. A portion of the outer periphery of transverse segment 72 is located adjacent to pedestal jaw roof 22 and another portion of this outer periphery is located adjacent to the upper portion of adapter pad 38 in order to form the abutment for contacting the adapter pad. Transverse stop member segment 72 is located to abut adapter pad upper forming member 50.

Adapter pad stop member 70 is formed by bending a length of cross-sectionally circular material into the desired U-shape with the spacing of legs 74 sufficient to permit welding to opposite sides of the stop lug. Functionally, adapter pad stop member 70 operates the same as the adapter pad stop member described immediately above. Adapter pad stop member 70 has certain advantages in that it can be easily and readily formed from common bar stock material which simplifies manufacturing. The diameter of the material from which adapter pad stop member 70 is formed can be selected so that positioning the upper portion of the member against the stress concentration relief curvature 30 will position the peripheral abutment portion of the curvature from pedestal jaw roof 22 so it can contact adapter pad upper forming member 50.

Figure 7:
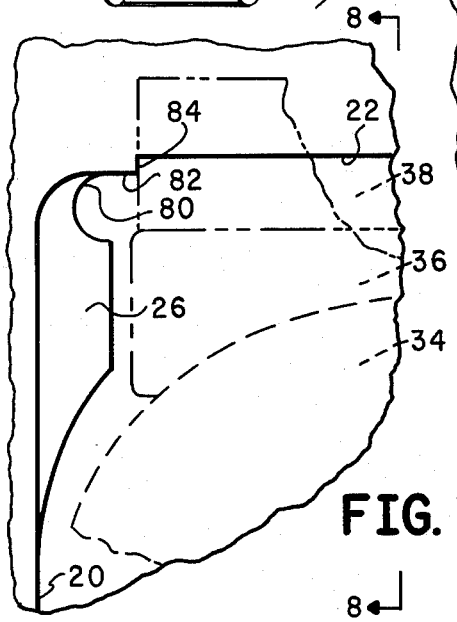
FIG. 7 is an elevation view of a fragment of a side frame pedestal jaw employing another embodiment of the adapter pad centering device wherein the adapter pad stop member is integrally formed in the side frame and having the bearing, bearing adapter and adapter pad shown in dashed lines.
Figure 8:
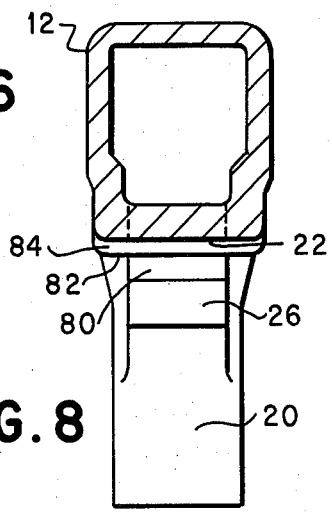
FIG. 8 is a cross-sectional view of a side frame employing the adapter pad centering device shown in FIG. 7 with this view taken along line 8—8 of FIG. 7.

FIGS. 7 and 8 show another embodiment of the adapter pad centering device of this invention wherein the adapter pad stop member is formed in a portion of the side frame. In this embodiment, the juncture of pedestal jaw outer wall 20 and pedestal jaw roof 22 is formed with a stress concentration relieving recess 80 which curves from pedestal jaw outer wall 20 to a location spaced below pedestal jaw roof 22 where that end portion is defined by a horizontally disposed segment or shoulder 82 extending laterally across the side frame. An abutment 84 joins the inner edge of horizontal segment 82 and connects with pedestal jaw roof 22 thereby forming the adapter pad stop abutment. Abutment 84 is substantially perpendicular to pedestal jaw roof 22 and extends downward therefrom a distance sufficient to restrain the upper internal forming member of adapter pad 38. Each side of both pedestal jaws in a side frame can be constructed in a configuration shown in FIGS. 7 and 8 in order to position the adapter pads for operation as described in detail above. This embodiment of the adapter pad centering device of this invention is not particularly well suited for retrofitting existing AAR standard side frames as shown in FIG. 1, but it is intended for incorporation into new units where the truck is to be equipped for radial steering. It is to be noted that pedestal jaws of a side frame can be constructed with an abutment 84 at only the outer walls or it can be constructed on the order of that shown in FIG. 1 with such a stop at both sides of the adapter pad jaw.

Figure 9:
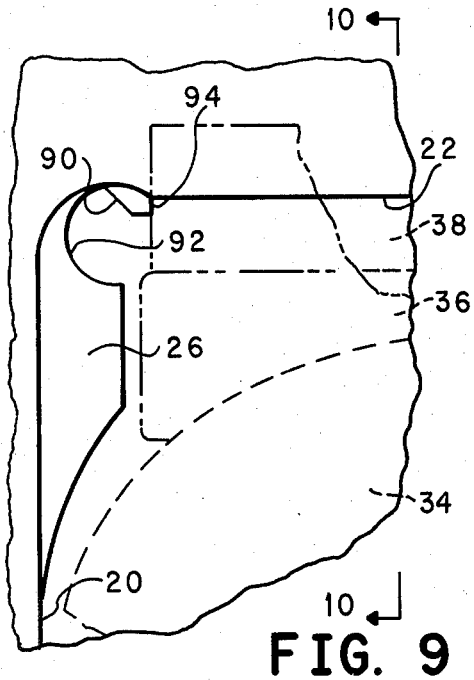
FIG. 9 is an elevation view of a fragment of a side frame pedestal jaw employing another embodiment of the adapter pad centering device wherein the stop member formed extends from the stres relief curvature of the side frame and having the bearing, bearing adapter and adapter pad shown in dashed lines.
Figure 10:
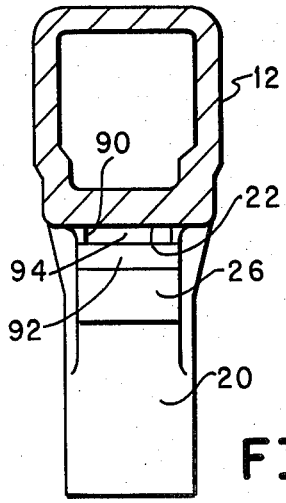
FIG. 10 is a cross-sectional elevation view of a side frame employing the adapter pad centering device shown in FIG. 9 with this view taken along line 10—10 in FIG. 9.

FIGS. 9 and 10 show another embodiment of the adapter pad centering device of this invention wherein the adapter pad abutment is formed on an adapter pad stop member 90 that is integrally constructed with the side frame. At the juncture of pedestal jaw outer wall 20 and pedestal jaw roof 22, a curved stress concentration relieving recess 92 is located. Stress concentration releiving recess 92 is curved and at its highest point extends vertically above the pedestal jaw roof 22. Adapter pad stop member 90 is formed as a protrusion that extends downwardly from the upper portion of stress concentration relieving recess 92 through the lateral center portion of side frame 12. Adapter pad stop member 90 extends vertically downward below pedestal jaw roof 22 and has a flat surface on the inner side thereof forming the adapter pad stop abutment 94 which is generally perpendicular to pedestal jaw roof 22. Abutment 94 extends downward below pedestal jaw roof 22 sufficient to restrain the adapter pad upper internal forming member thereby retaining the adapter pad in the desired centered position in the pedestal jaw. This embodiment of the adapter pad centering device functions the same as the embodiments described above. This embodiment of the adapter pad centering device is intended to be incorporated into new construction of side frames wherein adapter pad stop member can be integrally formed. It is to be noted that such a side frame can be constructed with an adapter pad stop 90 formed only at the outer walls or it can be constructed on the order of that shown in FIG. 1 with two adapter pad stops in each pedestal jaw. However, it is to be noted that if desired, it is possible to weld an adapter pad stop member having the cross-sesctional shape of stop member 90 into the stress concentration relieving recess of an AAR standard side frame, as shown in FIG. 1, in order to obtain a similar net result.

The embodiments of the invention in which an exclusive property or privilege is claimed are defined as follows:

1. In a railway car truck side frame for a radially steerable railway car truck having means to mount a bolster in a center portion thereof, pedestal jaw on opposed end portions thereof for mounting wheel assemblies comprised of axles with wheels thereon, axle bearing assemblies bearing adapters securely attached to and mounted above said bearings, and resilient bearing adaptor pads mounted between said bearing adapters; an improvement in said side frame comprising:

an adapter pad centering means, including an adapter pad stop on said side frame at each pedestal jaw on the outermost sides of said pedestal jaw openings at the roof thereof wherein each of said adapter pad stops has an abutment extending transverse to said side frame, said abutments being in a spaced relation to the opposed side of the respective pedestal jaw such that when an adapter pad is positioned within the pedestal jaw an upper portion thereof is restrained from significant outward movement in the longitudinal direction of said side frame while a lower portion of said adapter pad is not restrained from this longitudinal movement thereby permitting temporary displacement in this outward direction of an associated bearing adapter axle bearing and axle by deformation of said truck without causing permanent displacement of said adapter pad toward an outwardly disposed position within said pedestal jaw.

2. The adapter pad centering means of claim 1, wherein each said adapter pad stops is formed by a transverse segment of a generally U-shaped member wherein said U-shaped member has the legs thereof rigidly mounted to opposed inner and outer side portions of said side frame such that said transverse segment lies at said pedestal jaw roof thereby forming said abutment.

3. The adapter pad centering means of claim 2, wherein said U-shaped member is a cross-sectionally generally round member having end portions of said legs welded to said side frame and having an upper portion of said transverse segment contacting said pedestal jaw roof.

4. The adapter pad centering means of claim 2, wherein said adapter pad has generally parallel and substantially planer end surfaces within said pedestal jaw and said transverse segment of each U-shaped member has a planer surface oriented substantially parallel to the associated adapter pad planer end surface and lying adjacent thereto said adapter pad is positioned within said pedestal jaw.

5. The adapter pad centering means of claim 1, wherein said side frame has an arcuate recess at the juncture of each end of said pedestal jaw roof and the associated side thereof and said side frame has a protrusion extending from the confines of the arcuate recess at said pedestal jaw outer walls toward the opening of said pedestal jaw and transverse to said side frame at least across a major portion of said pedestal jaw roof such that one side of each of said protrusions forms one of said abutments.

6. The adapter pad centering means of claim 5, wherein said protrusions are each formed integrally with said side frame and extend across said side frame substantially less than the width of said side frame of said pedestal jaw opening.

7. The adapter pad centering means of claim 1, wherein said side frame has a shoulder formed within each of said pedestal jaw openings at the juncture of said roof and said outer side thereof and extending transverse to said side frame between inner and outer sides of said side frame, said shoulders each have a facing surface generally perendicular to the associated pedestal jaw roof and forming said abutments.

8. The adapter pad centering means of claim 7, wherein said side frame has a stress concentration relieving transverse recess formed therein at the juncture of each outer sides of said pedestal jaw opening with said shoulder, such that said shoulder extends between the uppermost portion of said recess and said pedestal jaw roof.

9. The adapter pad centering means of claim 1, wherein each of said pedestal jaws of said frame has one of said adapter pad stops at each end of said pedestal jaw roof.

10. In a railway car truck side frame having pedestal jaws on opposed end portions thereof for mounting railway car wheel assemblies comprised of axles with wheels mounted thereon, axle bearing assemblies mounted on each end of each axle, bearing adapters mounted over said bearing assemblies and a resilient adapter pad rigidly mounted to an upper portion of said bearing adapter, and wherein said side frame has stop lugs formed on facing side walls of each pedestal jaw; an improvement in said side frame comprising:

an adapter pad centering means including a pair of rigid adaper pad stops mounted on said side frame wherein each of said stops has an abutment in a spaced relation to the other and said stops are positioned adjacent to the roof of a railway car truck side frame pedestal jaw to restrain the upper portion of an adapter pad when positioned between said abutments while not restraining a lower portion of an adapter pad from longitudinal movement thereby permitting temporary displacement of a bearing adapter, an bearing and an axle by deformation of a resilient adapter pad from a centrally disposed position within said pedestal jaw to a displaced position and permitting the return to a centrally disposed position within said pedestal jaw to a displaced position and permitting the return to a centrally disposed position without permanent displacement of an adapter pad from between said abutments.

11. In a railway car truck side frame having pedestal jaws on opposed end portions thereof for mounting railway car wheel assemblies comprised of axles with wheels mounted thereon, axle bearing assemblies mounted on each end of each axle, bearing adapters mounted over said bearing assemblies and a resilient adapter pad rigidly mounted to an upper portion of said bearing adapter, and wherein said side frame has stop lugs formed on facing side walls of each pedestal jaw;

an adapter pad motion limiting means including a pair of rigid adapter pad stops on a side frame within each pedestal jaw wherein each of said stops has an abutment positioned adjacent to the pedestal jaw roof and a pedestal jaw outer wall in order to restrain the upper portion of an adaper pad from longitudinally outward motion relative to the center portion of said side frame and thereby permitting temporary displacement of the lower portion of an adapter pad, a bearing adapter, an axle bearing and an axle by deformation of a resilient adapter pad to a displaced position and permitting return to the original position thereof without permanent displacement of the adapter pad in an outward direction.

* * * * *